US005084139A

United States Patent [19]

Autio

[11] Patent Number: 5,084,139

[45] **Date of Patent: * Jan. 28, 1992**

[54] FRAME CONSTRUCTION FOR A COMPACT PRESS SECTION

[75] Inventor: Markku Autio, Jyvaskyla, Finland

[73] Assignee: Valmet Paper Machinery Inc., Finland

[ * ] Notice: The portion of the term of this patent subsequent to Aug. 26, 2003 has been disclaimed.

[21] Appl. No.: 639,226

[22] Filed: Jan. 9, 1991

Related U.S. Application Data

[60] Division of Ser. No. 484,359, Feb. 22, 1990, abandoned, and a continuation of Ser. No. 57,097, Jun. 2, 1987, Pat. No. 4,909,905.

[30] Foreign Application Priority Data

Jun. 3, 1986 [FI] Finland ..... 862356
Apr. 14, 1987 [FI] Finland ..... 871652

[51] Int. Cl.[5] ..... A21F 3/04

[52] U.S. Cl. ..... 162/360.1; 162/273; 162/274

[58] Field of Search ..... 162/272, 273, 274, 360.1, 162/305, 358

[56] References Cited

U.S. PATENT DOCUMENTS 4,452,669 6/1984 Koski ..... 162/360.1
4,608,125 8/1986 Autio ..... 162/273
4,657,634 4/1987 Autio ..... 162/273
4,909,905 3/1990 Ilmarinen et al. ..... 162/360.1

*Primary Examiner*—Karen M. Hastings
*Attorney, Agent, or Firm*—Steinberg & Raskin

[57] ABSTRACT

A closed press section in a paper machine is disclosed in which all of the press nips in which substantial dewatering occurs are formed between one or the other of two smooth-faced center rolls and hollow-faced press rolls. The web runs between the nips adhering to the surface of one or the other smooth-faced center roll from the first nip to the last nip alone a substantially S-shaped path so that opposite surfaces of the web contact the surfaces of respective ones of the smooth faced center rolls. The frame construction of the press section includes front and rear frames between which an intermediate space is defined which is open or openable at its top, the front and rear frames not being connected to each other above the press roll combination, at least not permanently. The first center roll is supported on the front frame while the second center roll is supported on either the rear frame, on a separate front part of the rear frame, or on a separate intermediate frame. The frame construction, press fabrics and press rolls are arranged such that the open-topped intermediate space between the front and rear frames is used to facilitate the replacement of the press rolls in a vertical direction through the space and at least the upper press fabrics.

19 Claims, 11 Drawing Sheets

FRAME CONSTRUCTION FOR A COMPACT PRESS SECTION

This application is a divisional application of pending prior application Ser. No. 07/484,359 filed Feb. 22, 1990, now abandoned which prior application is a continuation application of Ser. No. 057,097 filed on June 2, 1987, now U.S. Pat. No. 4,909,905, issued Mar. 20, 1990.

BACKGROUND OF THE INVENTION

The present invention relates to press sections in paper machines for dewatering paper webs and, more particularly, to closed press sections comprising a compact press roll combination in which several press nips are formed by various press rolls between which nips the web runs supported on the surface of a roll without substantial open draws.

The invention also relates to a frame construction for a paper machine press section, the press section comprising a compact press roll combination in which several press nips are formed by various rolls between which the web runs supported by a roll surface without substantial open draws.

Paper machine press sections generally comprise several press nips formed by pairs of rolls through which the paper web and dewatering fabrics, such as press felts or pairs of press felts, run. In this connection, reference is made to the press sections disclosed in Finnish Applications Nos. 78 1426 and 82 1995, and to U.S. Pat. No. 4,209,361, all assigned to the assignee of the instant application. Reference is also made to Canadian Patent 1,068,525 and U.S. Pat. No. 4,075,056 of Beloit Corporation.

U.S. Pat. No. 4,209,361 discloses the well-known "Sym-Press II" press section currently finding widespread use by various paper manufacturers. Several advantages are obtained by using this press section which are of practical importance. One of the most important advantages is that the paper web can be passed through the entire press section as a closed draw supported on a solid surface, first between the first and second nips on a pick-up felt, over a sector of the press-suction roll and then on the smooth surface of the center roll of the press, usually a rock roll, and then through the third nip.

The general principles and theories of the passing of paper webs will not be described since they are well-known to those skilled in the art. However, a brief discussion as to the particular problems that occur in the pressing of thin paper qualities is useful as a background to the present invention. A significant problem in the dewatering of thin paper qualities is the rewetting of the web. Such rewetting occurs in the "Sym-Press II" press section, particularly between the first and second nips in which the same felt, which also functions as a pick-up felt, is used as a press felt. On the other hand, the center rock roll does not rewet the web. Another problem in the pressing of thin paper qualities is that the pressure exerted on the web in any of the nips is limited. In the case of thin paper qualities, two-sided dewatering is not necessary when the dry solid content of the web is increased in the press section, such as from about 16% to about 45%, since the quantity of water to be removed corresponds to a water layer of only about 0.18 mm. The two felts in the first nip, together with the soft coating on the suction roll, causes a relatively low peak pressure in the first nips, which reduces their efficiency.

Presses of the "Sym-Press II" type have the characteristic that only one side of the web is pressed against the smooth surface of the rock roll or against a corresponding surface of synthetic material, so that the web becomes at least to some extent asymmetric. Although this does not have a major harmful effect on most paper qualities, it is not desirable in the case of thin paper qualities.

SUMMARY OF THE INVENTION

One object of the present invention is to provide a modification of the "Sym-Press II" press section which is especially suited for dewatering thin paper qualities, i.e., paper qualities whose grammage is lower than about 60 g/m$^2$.

Another object of the present invention is to provide a new and improved press section which eliminates the above-discussed problems encountered in the pressing of thin paper qualities in conventional press sections.

Still another object of the present invention is to provide a new and improved press section in which press-suction rolls are not required in any of the press nips and are not loaded with nip pressures. In this connection, it is known that press-suction rolls are expensive components that consume significant amounts of energy. Press-suction rolls are also disadvantageous in that they cause uneven dewatering when used as one press roll in a press nip due to the perforation patterns in their mantles.

A further object of the present invention is to provide new and improved press sections in which the nip pressure distribution, i.e., the shape of the nip press curve, and the maximum compression pressure, is optimal with respect to dewatering thin paper qualities. For example, the dewatering of newsprint, a typical application of a press section in accordance with the invention, should preferably be accomplished at a higher maximum pressure in the initial press nips than is the case in practice in a two-felt nip of a "Sym-Press" press or similar press sections. The reason for using two felts in a nip, namely, to provide two-sided, symmetric dewatering, is not a requirement in the case of dewatering thin paper qualities.

A still further object of the present invention is to provide a new and improved press section in which the characteristic property of the "Sym-Press" presses, namely, the support of the paper web through the entire press section on a solid surface, without substantial open draws, is maintained.

Another object of the present invention is to provide a new and improved press section having a frame construction that provides reduced vibration so that in certain embodiments of the invention, the press section frame can be constructed with a lower height and more rigidly than is conventional so that even its lowest frequencies of specific vibration are higher than in conventional press sections.

Still another object of the present invention is to provide a new and improved frame construction for a press section in accordance with the invention or equivalent press section by means of which the replacement of press rolls and press fabrics is facilitated, thereby reducing down time of the paper machine and increasing production output. In this connection, large diameter center rolls, for example rock rolls, are utilized in the invention, such center rolls weighing up to about 70,000 kg. The replacement of such large, heavy rolls has in the past involved significant problems. Furthermore, the replacement of modern press fabrics of the type formed of rigid plastic material is difficult because they cannot be packed into bundles in the lateral direction.

Yet another object of the present invention is to provide a new and improved frame construction for a press section that provide reduced vibration so that in accordance with certain embodiments of the invention, the frame of the press section can be made shorter and more rigid than in the case of the prior art and so that even its lowest frequencies of specific vibration are higher than in prior art frame constructions.

Briefly, in accordance with one embodiment of the present invention, these and other objects are attained by providing a press section wherein each of all of the press nips in which substantial dewatering occurs is formed between one of two smooth-faced center rolls and a corresponding one of the hollow-faced press rolls, a press felt arranged to run around the press rolls through a nip formed by the press rolls to receive water from the web in the nip and to transfer water out of the nip, the web running through the press section adhering to the surface of the smooth-faced center rolls substantially from the first press nip to the last press nip along a substantially S-shaped path so that both sides of the web are pressed against the surfaces of respective center rolls, and wherein the diameters of the center rolls are substantially larger than the diameters of all or most of the hollow-faced or equivalent press rolls.

The objects of the invention are also attained by providing in accordance with a second embodiment of the invention, a press section for use only in dewatering very thin paper qualities whose opposite surfaces do not have to be symmetric, the press section including only a single large diameter smooth-faced center roll, preferably a rock roll, in connection with which at least two separate press nips are formed with corresponding hollow-faced rolls whose diameters are substantially smaller than the diameter of the center roll, each press nip being provided with its own press felt.

The objects of the invention are also attained by providing a frame construction comprising a front frame and rear frame between which an intermediate space that is open or openable at the top is provided, the front and rear frames not being connected, at least not permanently, to each other above the rolls in the press roll combination, wherein the first center roll is supported on the front frame and the second center roll is supported on the rear frame, on a separate front part of the rear frame, or on a separate intermediate frame, and wherein the press fabrics and press rolls are arranged in a manner such that the open-topped intermediate space can be utilized in the replacement of the press rolls and at least the upper press fabrics.

DESCRIPTION OF THE DRAWINGS

A more complete appreciation of the present invention and many of the attendant advantages thereof will be readily understood by reference to the following detailed description when considered in connection with the accompanying drawings in which.

DETAILED DESCRIPTION OF THE PREFERRED EMBODIMENTS

Figure 1:
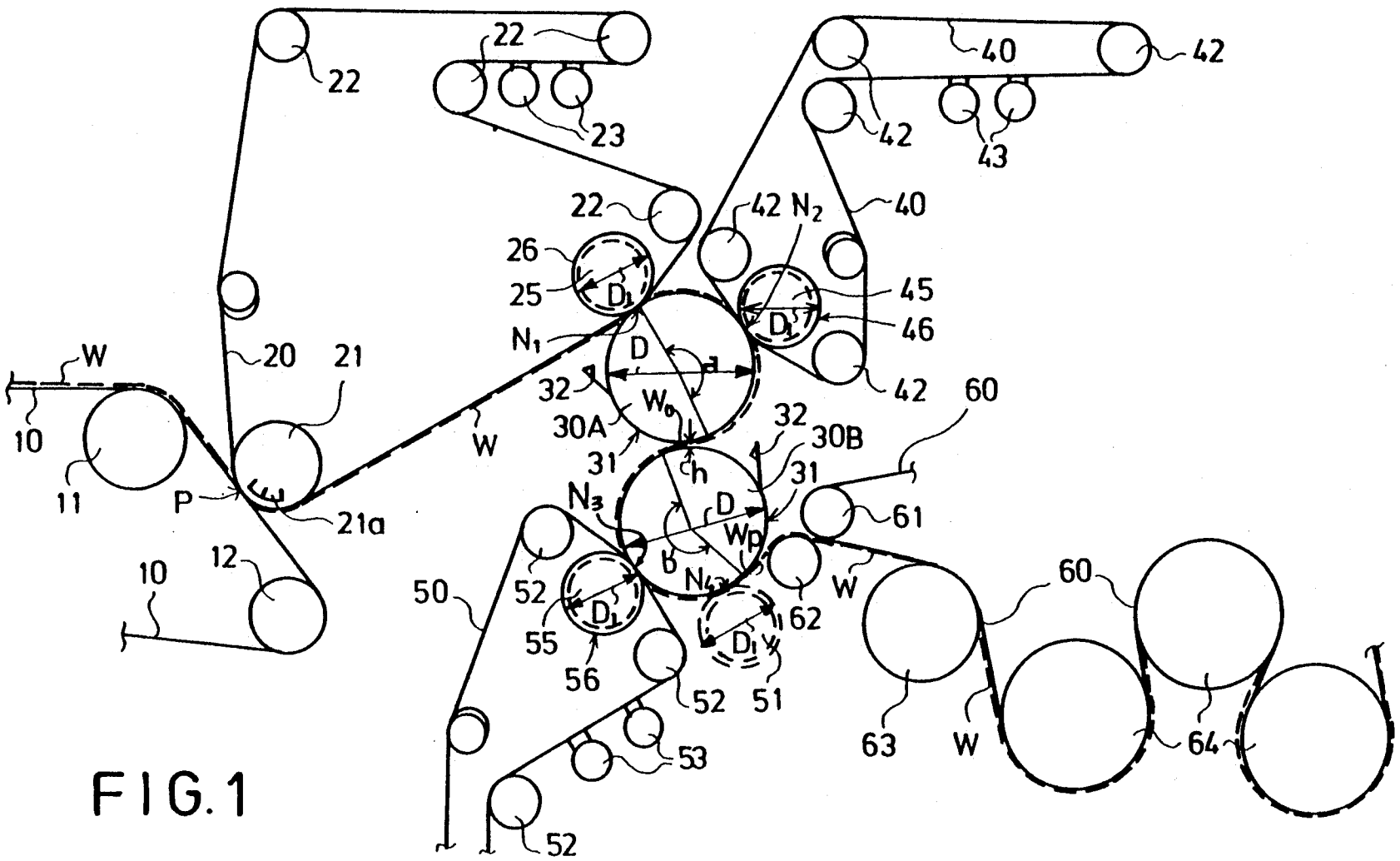
FIG. 1 is a schematic side elevation view of a press section in accordance with the invention wherein two center rolls are situated one above the other with the web to be pressed running from the upper center roll to the lower center roll.

Referring now to the drawings wherein like reference characters designate identical or corresponding parts throughout the several views, the features of a press section in accordance with the invention that the embodiments shown in FIGS. 1–6 have in common will now be described. The web W arrives at the press section on a wire 10 of the forming section of the paper machine. The web W is separated from the forming wire 10 on a downwardly inclined run thereof between the rolls 11 and 12 at a pick-up point $P;P_1$, and is transferred onto the pick-up felt 20 by means of the negative pressure in the suction zone 21*a* of the pick-up roll 21. In the case of the embodiments of FIGS. 1, 4 and 6, the web W is transferred directly into the first nip $N_1$ on pick-up felt 20. In the case of the embodiments of FIGS. 2, 3 and 5, the web W is transferred from the pick-up fabric 20 onto a first press fabric 28 at a second pick-up point $P_2$ and the web W is transferred into the first nip $N_1$ on the first press fabric 28.

In the embodiments of FIGS. 1–5, the press section includes two large-diameter smooth-faced center rolls 30A and 30B in connection with which all of the substantially dewatering press nips are formed. The center rolls 30A and 30B are preferably rock rolls or rolls provided with a surface having corresponding web-transfer properties such, for example, as rolls provided with Microrock coatings.

Figure 6:
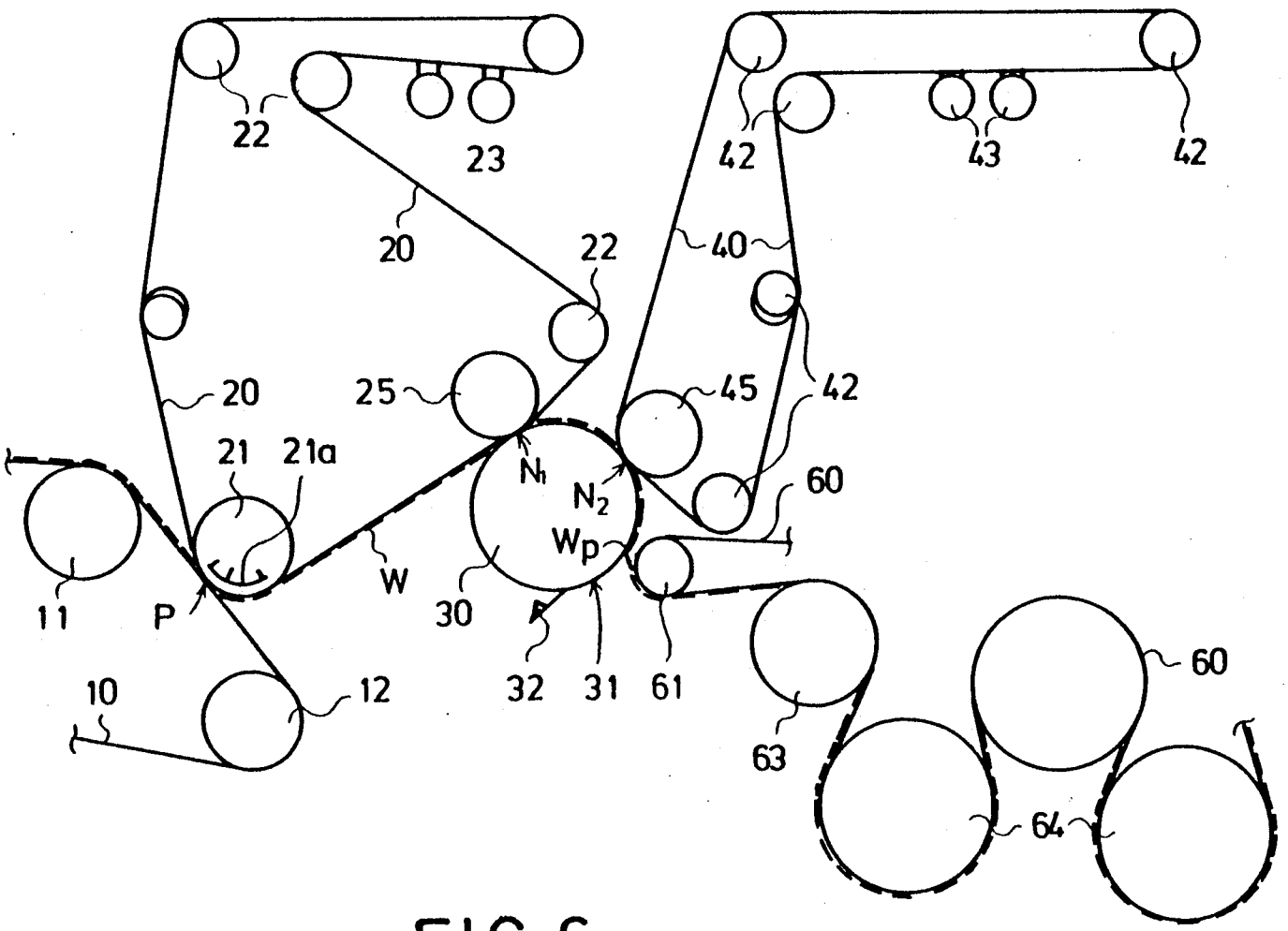
FIG. 6 is a schematic side elevation view of a press section in accordance with the invention which is used only in special cases and wherein only a single center roll is used.

On the other hand, the embodiment of the invention illustrated in FIG. 6 substantially differs from the main embodiments described above in that it includes only a single center roll 30. Press sections in accordance with the FIG. 6 embodiment can be used only in connection with dewatering very thin paper qualties.

The first dewatering nip $N_1$ in the press is formed between a press roll 25 having a hollow surface 26 and the first center roll 30A. In the first nip $N_1$ the pick-up fabric 20 or the first press fabric 28 acts as a press fabric and as means for transferring water out of the web W. The pick-up fabric 20 and first press fabric 28 are guided by means of guide rolls 22. The fabrics are reconditioned by means of reconditioning devices 23.

After the first nip $N_1$, the web W is transferred, while supported and firmly adhering to the smooth surface of the first center roll 30A, into the second nip $N_2$ formed between the first center roll 30A and a press roll 45 having a hollow surface 46. A press felt 40 guided by guide and spreader rolls 42 passes through the second nip $N_2$ and receives water from the web W. Reconditioning devices 43 are provided for the press felt 40. Since the surface of the center roll 30A is more adhesive relative to web W than is press felt 40, the web follows along with the center roll 30A after passing through the second nip $N_2$ and remains in secure contact with the smooth surface 31 of roll 30A. For the same reason, the web W remains in contact with the smooth surface 31 of roll 30A after the first press nip $N_1$. The web W is then detached from the surface 31 of smooth-faced center roll 30A and passes over an open draw $W_0$ which is as short as possible and moves onto the surface 31 of the lower, second center roll 30B whose diameter is substantially the same as that of the first center roll 30A.

A third press nip $N_3$ is formed by the second center roll 30B and a press roll 55 having a hollow surface 56. A press felt 50 guided by guide and spreader rolls 52 and reconditioned by devices 53 passes through the third nip $N_3$. After the third press nip $N_3$, and a possible fourth press nip $N_4$ formed between the second center roll 30B and a hollow-faced press roll 51 (shown in phantom), the web W is passed over a very short open draw Wp onto the drying wire 60 of the drying section. The wire 60 is guided by guide roll 61 into proximity with the second center roll 30B. While adhering to the surface of the drying wire 60 and possibly guided by the guide roll 62, the web W is passed onto the lead-in cylinder 63 of, e.g., a single-wire draw drying section, and then further into the first drying group formed by the drying cylinders 64.

The particular features of the embodiments of the invention illustrated in FIGS. 1–6 will now be described.

Referring first to FIG. 1, the web W is passed on the pickup fabric 30 after the pick-up point P along an upwardly inclined path into the first press nip $N_1$ in which the pick-up felt 20 acts as the press fabric. The first press nip $N_1$ is located on the upper portion of the circumference of the first center roll 30A and the second press nip $N_2$ is situated at a distance from the first press nip of about 90°. After passing through the second press nip $N_2$, the web W follows on the surface 31 of the first center roll 30A to a separation point over another sector of about 90° so that the total sector a within which the web W contacts the surface of the first center roll 30A is about 180°. Doctors 32 are provided to clean the free sectors of the center rolls 30A and 30B. The embodiment of the press section shown in FIG. 1 includes two center rolls, one 30A situated above the other 30B. In connection with the second center roll 30B, a third press nip $N_3$ and a possible fourth press nip $N_4$ are formed. The web W contacts the surface 31 of the second or lower center roll 30B over a total sector b which is in the range of between about 180° to 270°.

Figure 2:
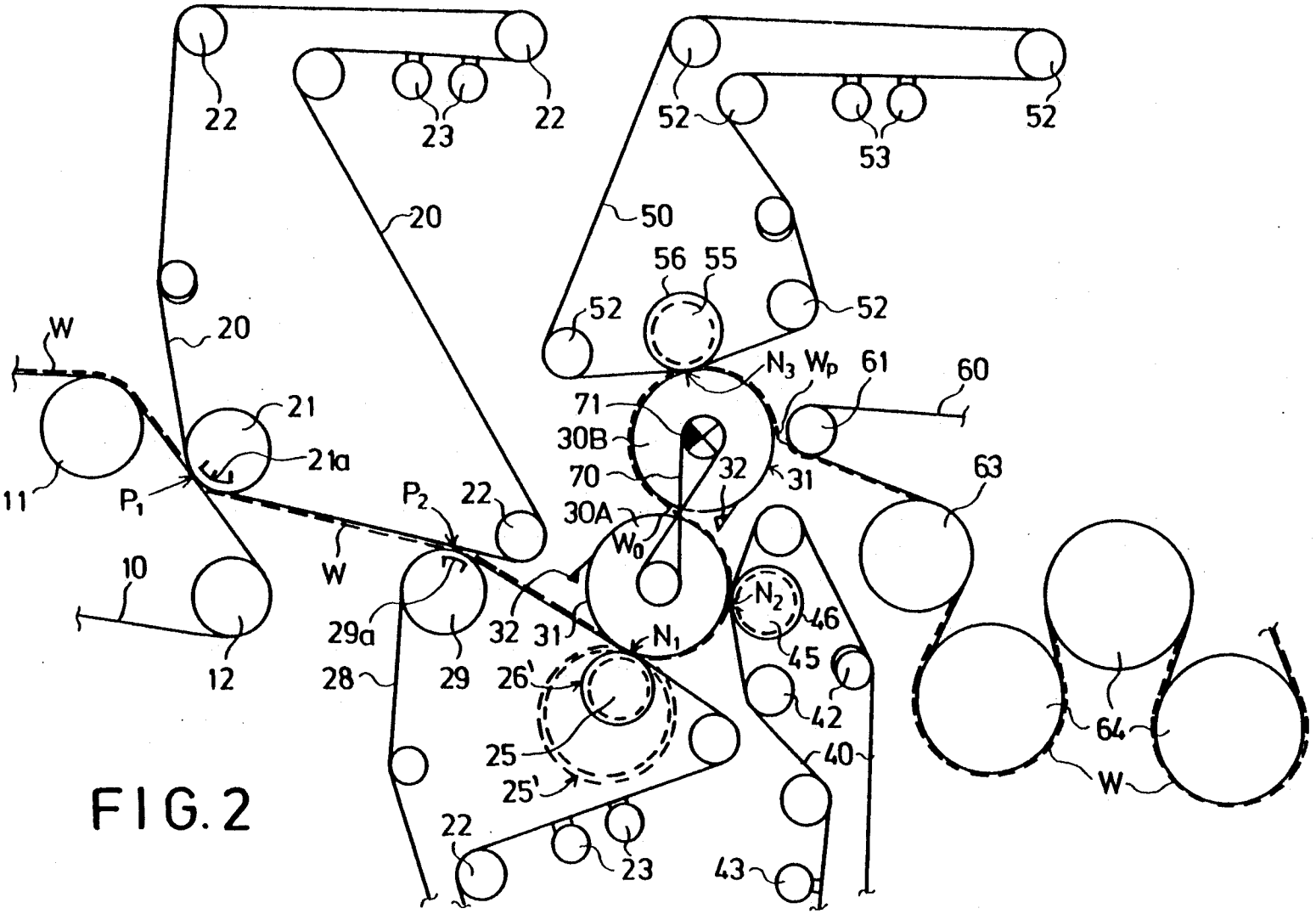
FIG. 2 is a schematic side elevation view of a second embodiment of a press section in accordance with the invention in which two center rolls are situated one above the other and wherein the web to be pressed runs from the lower center roll to the upper center roll.

According to the embodiment of FIG. 2, the web W which is detached from the forming wire 10 by the pick-up felt 20 at the pick-up point $P_1$, is transferred at a second pick-up point $P_2$ onto a first press fabric 28 which runs over a transfer-suction roll 29 provided with a suction zone **29*a*. In this embodiment, the first center roll 30A comprises the lower one of the two vertically disposed center rolls and the first press nip $N_1$ is formed on the lower circumference of the first center roll 30A between the center roll and a press roll 25 provided with a hollow surface. Alternatively, the press roll may be provided with an elastic coating 26' or, alternatively, may take the form of a large-diameter press roll 25' (shown in phantom). In the case where an elastic coating 26' is provided and/or a large diameter roll 25' is used, the length L of the nip $N_1$ (FIG. 7) can be substantially increased as compared to the length of a sharp roll nip. Such alternatives are also possible in connection with the other embodiments illustrated in FIGS. 1 and 3–6. Still referring to FIG. 2, the second nip $N_2$ is formed at a distance of a sector of about 90° rom the first nip $N_1$ and the third press nip $N_3$ is formed on the upper circumference of the second or upper center roll 30B. After travelling on the second center roll 30B after the press nip $N_3$ over a sector of about 90°, the web is detached as an open draw $W_p$ from the smooth surface 31 of the center roll 30B and transferred onto the drying wire 60**.

In the case of the embodiment of FIG. 2, where a large-diameter roll 25' or a press roll having a soft coating, e.g. a polyurethane coating of a hardness within the range of between about 5 to 35 P&J, is used instead of a hollow-faced roll, such as a groove roll or a blind-drilled roll, it is possible to use very high compression impulses and linear loads in the first press nip $N_1$ without risking crushing the web W. The same possibilities exist in connection with the center embodiments of FIGS. 1 and 3–6.

Figure 3:
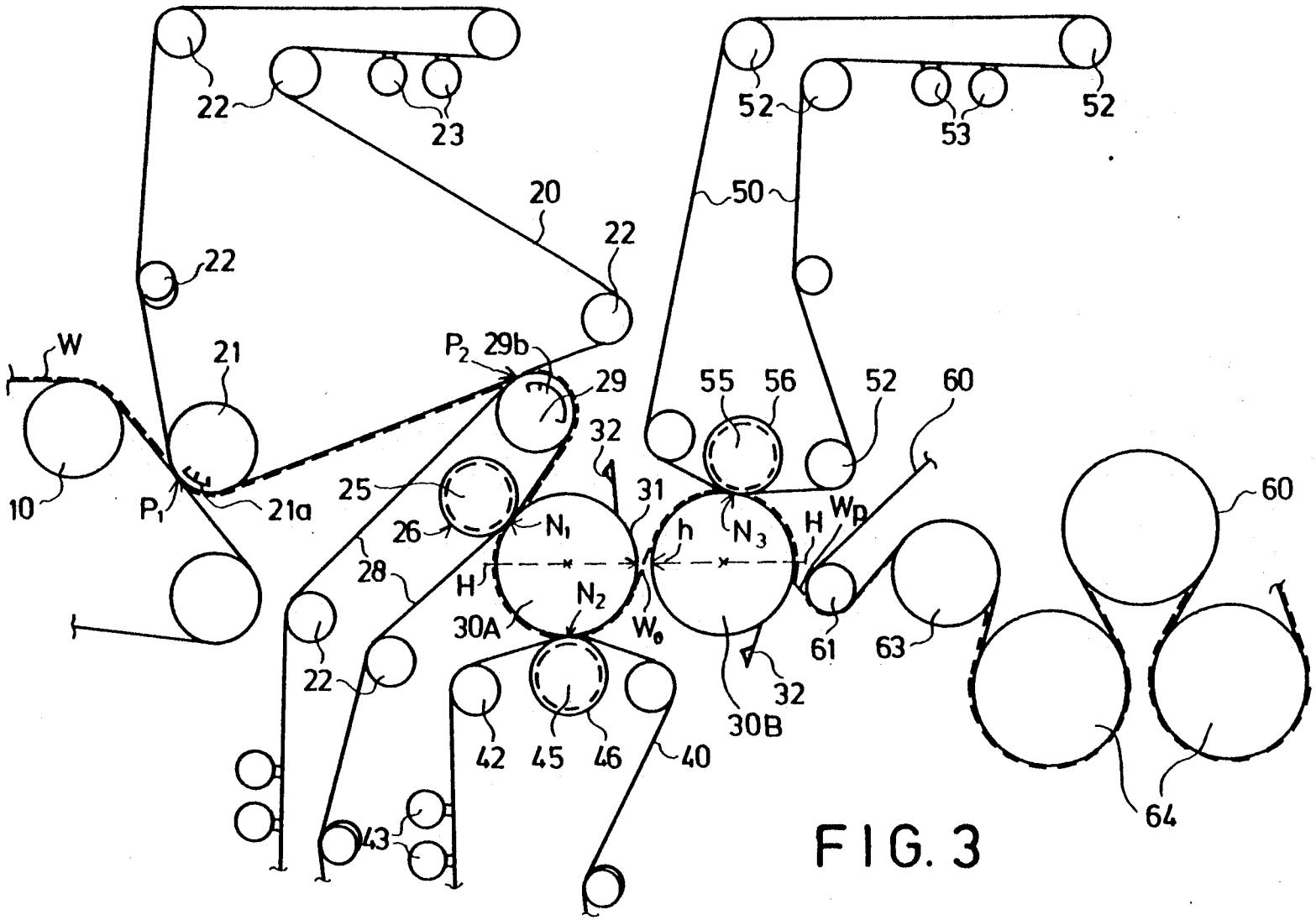
FIG. 3 is a schematic side elevation view of a third embodiment of a press section in accordance with the invention in which two center rolls are situated one after the other in the horizontal direction wherein the web is introduced onto the first center roll in the overall machine direction.

Referring now to FIG. 3 wherein a third embodiment of a press section in accordance with the invention is illustrated which includes two center rolls 30A and 30B that are situated in a substantially common horizontal plane H—H, the web is transferred on the pick-up fabric 20 to the pick-up point $P_2$ where it is transferred onto a first press felt 28 within the suction sector **29*b* of the transfer roll 29. From this point the web W is passed on the first fabric 28 downwardly into the first press nip $N_1$ formed on the upper half of the circumference of the first center roll 30A at a distance of a sector of about 45° from the horizontal plane H—H. The second press nip $N_2$ formed between the first center roll 30A and a hollow-faced press roll 45 is located at or near the lowest point on the circumference of the first center roll 30A, while the third press nip $N_3$ formed between the second center roll 30B and a hollow-faced press roll 55 is situated at or near the uppermost point of the circumference of the second center roll 30B. The web W is detached from the second center roll 30B** as an open draw $W_p$ substantially at the level of the plane H—H for transfer to the drying section of the paper machine.

Figure 4:
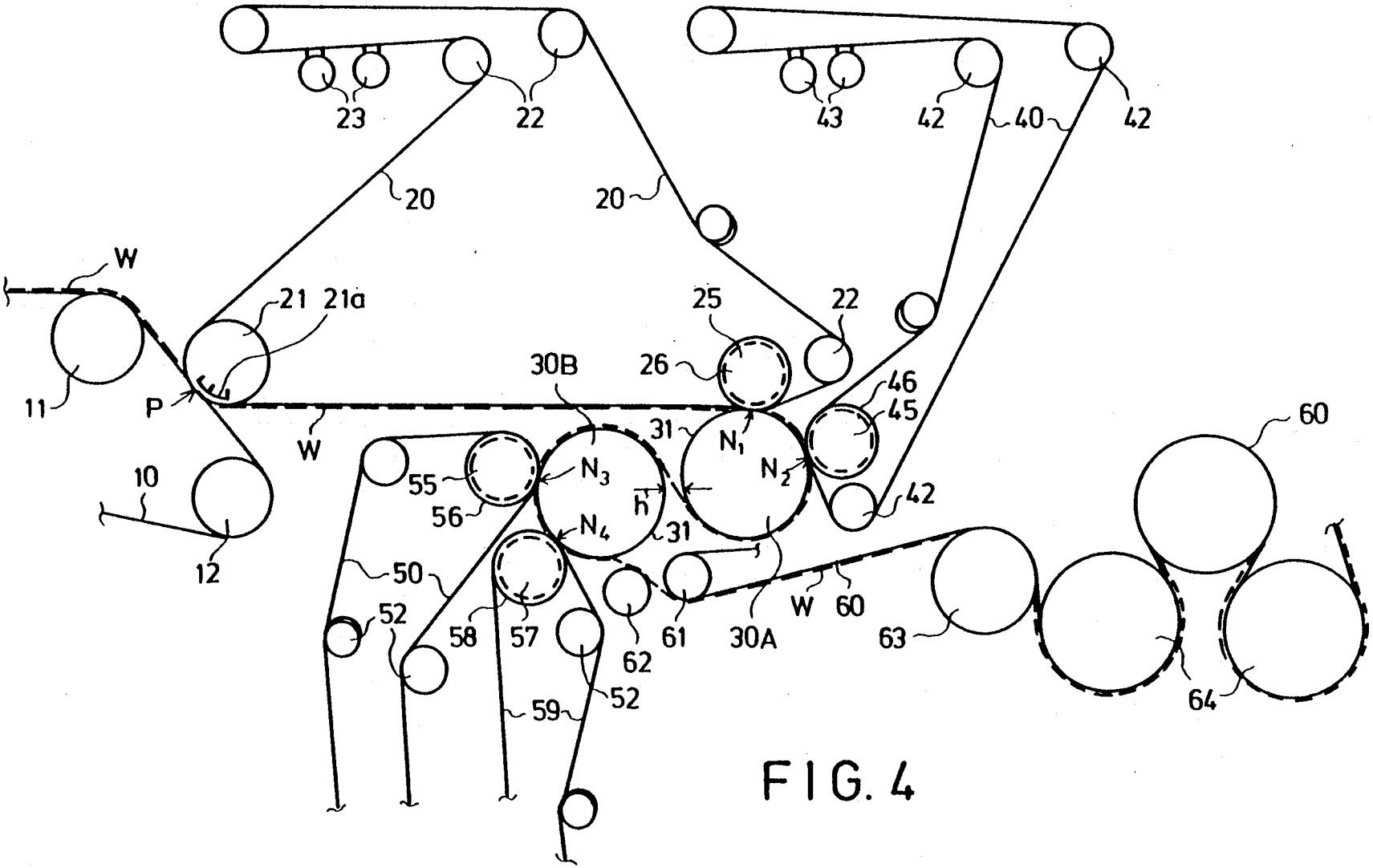
FIG. 4 is a schematic side elevation view of a fourth embodiment of a press section in accordance with the invention wherein the center rolls are situated one after the other in the horizontal direction and wherein the web to be pressed is introduced onto the second center roll in the overall machine direction.

Referring now to FIG. 4, another embodiment of a press section in accordance with the invention is illustrated wherein the two center rolls are situated one next to the other in a substantially common horizontal plane. However, in this embodiment the first center roll is the second center roll in the direction of overall web movement through the press section. In particular, the web W is transferred from the pick-up point P on the lower surface of the horizontal run of the pick-up felt 20 onto the first center roll 30A which is now the second of the two center press rolls in the overall direction of web movement through the press section. Both of the nips $N_1$ and $N_2$ are located on the first quarter segment of the first center roll 30A. The third press nip $N_3$ is located on the portion of the second center roll 30B facing the forming section. A fourth press nip $N_4$ is formed between the second center roll 30B and a press roll 57 having a hollow surface 58. A press felt 59 guided by guide and spreader rolls 52 runs through the fourth press nip $N_4$. The web W is separated from the smooth surface 31 of the second center roll 30B after the fourth nip $N_4$ and is passed onto drying wire 60 of the drying section guided by the guide roll 62.

Figure 5:
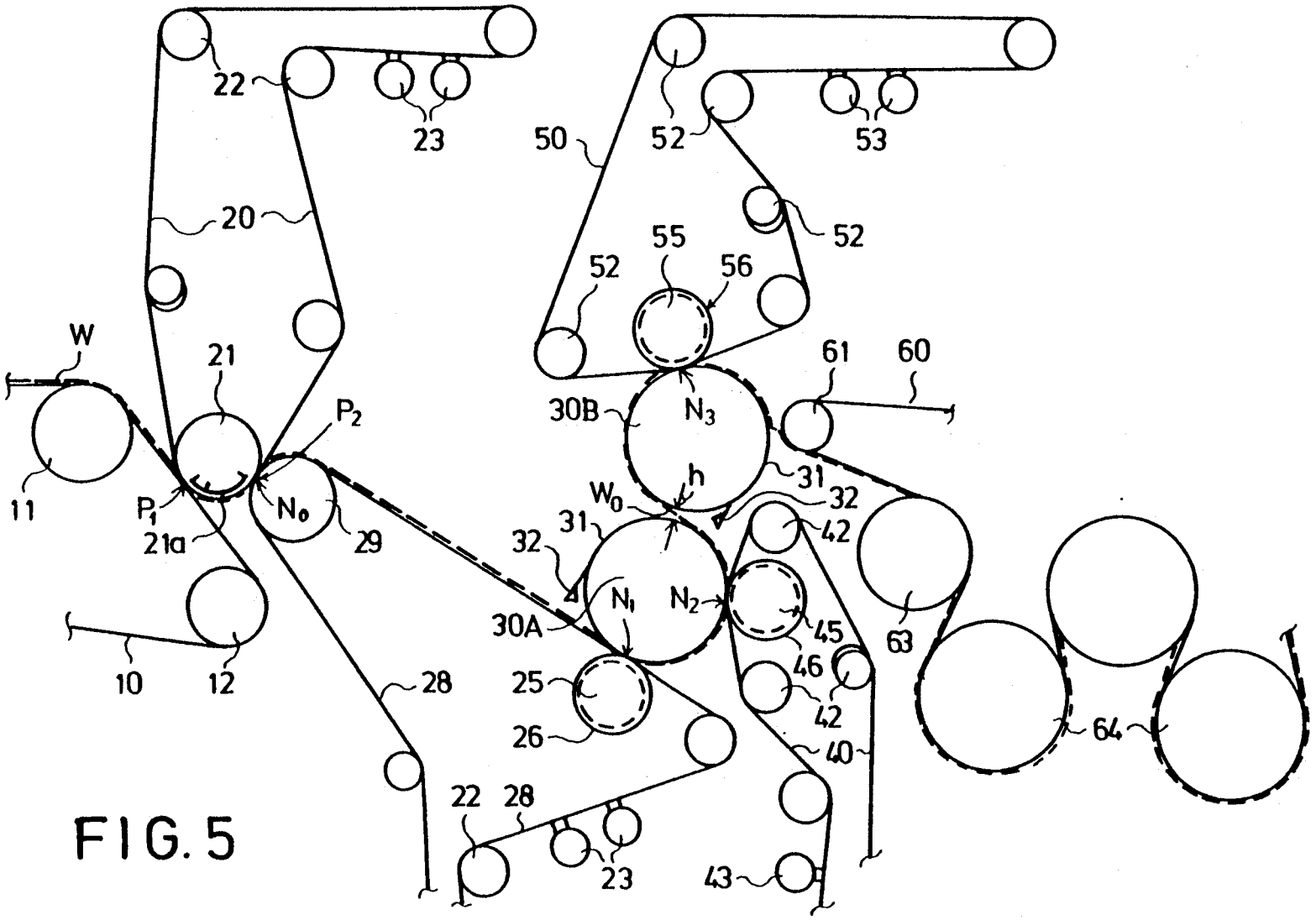
FIG. 5 is a schematic side elevation view of a fifth embodiment of a press section in accordance with the invention wherein the two center rolls are situated one above the other and wherein the web is passed through a transfer nip formed in connection with the pickup roll into the first nip.

Referring now to the embodiment of FIG. 5, the web W is transferred in a transfer nip $N_0$ formed between the pick-up roll 21 and a transfer roll 29 onto a press fabric 28 that transfers the web W into the first nip $N_1$. No dewatering of the web takes place in the transfer nip $N_0$, at least to a meaningful extent. In other respects, the construction of the press section shown in FIG. 5 is similar to that shown in FIG. 2.

As seen from FIGS. 1–5, it is an important feature of the invention that the web W be transferred along a substantially S-shaped path (or a mirror image of such a path) supported on the smooth surfaces of center rolls 30A and 30B so that the respective sides of the web that contact the smooth surface of the first center roll 30A and the coarse surface of the press fabrics 20, 28, 40, are reversed when the web passes to the second center roll 30B, e.g. the side of the web that contacted the coarse press fabrics 20, 28, 40 in conjunction with the first center roll now contacts the smooth surface 31 of the second center roll 30B. Thus, both sides of the web are treated symmetrically and the structure of the web and the distribution of fillers and fines through the web, a consideration depending upon dewatering directions, become substantially symmetrical.

Referring back to the FIG. 2 embodiment, one of the center rolls, namely, the second center roll 30B, is provided with its own mechanical drive 71. A mechanical transmission 70 shown schematically in FIG. 2 transmits operating power from the first center roll to the second center roll 30B. The ratio of the peripheral speeds of the center rolls 30A and 30B can in this manner be precisely controlled in order to ensure an optimal draw and elongation in the free draw $W_0$ whereby, for example, wrinkles in the web W are prevented and the draw and angle of detachment of the web can be rendered substantially constant.

Referring now to the embodiment of FIG. 6, a press section useful only in dewatering very thin paper qualities is illustrated. The press section includes only a single center roll 30 preferably comprising a rock roll having a smooth surface 31. The first and second press nips are formed on the upper half of the rock roll at a distance of a sector of about 90° from each other. The web W is detached from the center roll 30 at a point situated substantially at or proximate to an imaginary horizontal plane passing through the axis of the center roll 30. As noted above, the embodiment of FIG. 6 is suitable only for the production of very thin paper qualities, i.e., paper qualities in which equal smoothness and surface properties are not necessarily required for both sides of the web. Moreover, the embodiment of FIG. 6 is only suitable for very thin paper qualities because it comprises only two single-felt nips $N_1$ and $N_2$ and therefore has a dewatering capacity that is quite limited.

From the viewpoint of minimizing vibrations in the frame construction (not shown) of the press section embodiments discussed above, the most advantageous embodiments are the "horizontal" embodiments shown in FIGS. 3 and 4 wherein the two center rolls are located on substantially the same horizontal plane since the press nips formed in connection with those center rolls can be located at a relatively low level in the frame construction. In such a case, the part of the frame that carries the large masses and high loads can be made of relatively low height whereby the frame construction becomes rigid and the tendency for vibration is reduced. Under these conditions, even the lowest frequencies of specific vibration of the frame can reasonably be made quite high.

The following Table sets forth preferred dimensional and operational ranges of certain parameters of a press section in accordance with the invention.

| | 1st nip $N_1$ | 2nd nip $N_2$ | 3rd & 4th nip $N_3$ & $N_4$ |
|---|---|---|---|
| Linear Load kN/m | 60–150 | 80–160 | 100–170 |
| Max. pressure MPa | 3–7 | 4–10 | 6–12 |
| Nip length mm | 30–120 | 20–40 | 20–90 |
| Press roll 0 mm | 800–1600 | 600–1200 | 600–1600 |

The diameters D of the center rolls 30A an 30B are generally within the range of between about 1400 to 2000 mm, and most preferably within the range of between about 1500 to 1750 mm, e.g., about 1600 mm. According to the invention, the diameters D of the center rolls 30A and 30B are substantially larger than the diameters $D_1$ of the press rolls 25, 45, 55, 57 which form nips $N_1$–$N_4$ in connection with respective ones of the center rolls. The ratio of the diameters of the center rolls to the diameters of the hollow-faced press rolls is preferably within the range of $D/D_1 = 1.2$ to 3, and most preferably within the range of about 1.6 to 1.9.

As seen in the above Table, the linear loads and maximum pressures in the respective nips are increased gradually as the web W passes from the preceding nips to the following nips. Regarding the lengths L (FIG. 7) of the nips, the first press nip $N_1$ may advantageously be made in the form of a so-called extended nip wherein L is in the range of between about 40 to 120 mm., either by means of a soft roll coating or by passing an elastic compression mat (not shown) through the first nip $N_1$. In this connection, reference is made to Finnish applications Nos. 84 3895 and 85 0087.

The two center rolls 30A and 30B are situated as close to each other as possible in view of the constructional and operational aspects of the press machine. The gap h between the center rolls 30A and 30B is generally within the range of between about 20 to 80 mm and preferably within the range of between about 40 to 50 mm.

Figure 7:
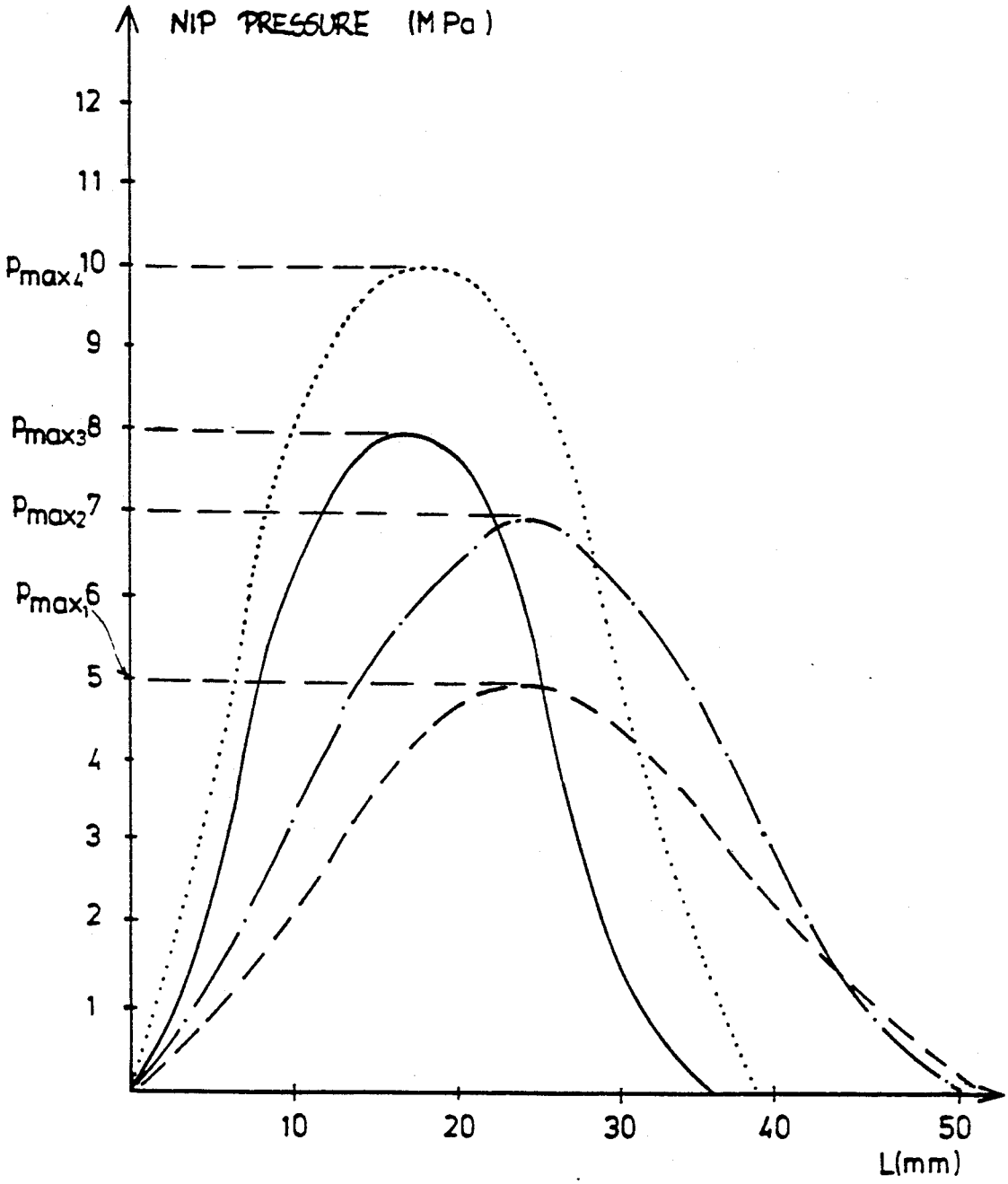
FIG. 7 is a graphical view illustrating compression pressure distributions and maximum pressures in various nips in a press section in accordance with the invention over the width of the press section.

Referring now to the graphical illustration of FIG. 7 in which the horizontal axis represents the width L of the nip in millimeters and the vertical axis represents the compression pressure (MPa), advantageous nip pressure distributions of the different nips $N_1$ to $N_4$ in a press in accordance with the invention are illustrated. The nip pressure in the first press nip $N_1$ is shown by the dash line. It is noted that the nip length is about 50 mm and the maximum compression pressure is about 5 MPa. The nip pressure in the second press nip $N_2$ is shown by the dot-dash line and it is seen that the maximum nip pressure $P_{max2}$ is slightly increased relative to the preceding nip, i.e., about 7 MPa. The pressure distribution in the third nip $N_3$ is shown by the solid line and it is seen that the length of nip $N_3$ is about 35 mm while the maximum compression pressure $P_{max3}$ is about 8 MPa. The compression pressure distribution in the fourth press nip $N_4$ is shown by the dotted line in FIG. 7 and the length of the nip $N_4$ is seen to be about 38 mm while the maximum compression pressure $P_{max4}$ is about 10 MPa. The pressure distributions are substantially symmetrical relative to the central plane of the respective nip.

As noted above and as seen from the above Table, the linear loads in the nips of a press section in accordance with the invention are such that the first nip $N_1$ has the lowest maximum pressure $P_{max1}$ and the following nips have successively higher nip pressures, i.e., $P_{max1}$, $P_{max2}$, $P_{max3}$ and $P_{max4}$.

When the pressure distribution in the various nips $N_1$ to $N_4$, whose essential constituent factors are the nip length L and the maximum compression pressure $P_{maxN}$, are chosen in accordance with the principles illustrated in the example of FIG. 7, an optimal pressing result is obtained for thin paper webs, i.e., paper webs whose grammage is lower than about 60 g/m$^2$. The areas below the several curves in FIG. 7 represents the overall impulse of dewatering compression of the web W as it passes through the press section. The overall impulse is limited by factors related to the machine construction so that its magnitude is, therefore, always proportional to the linear load.

Figure 8:
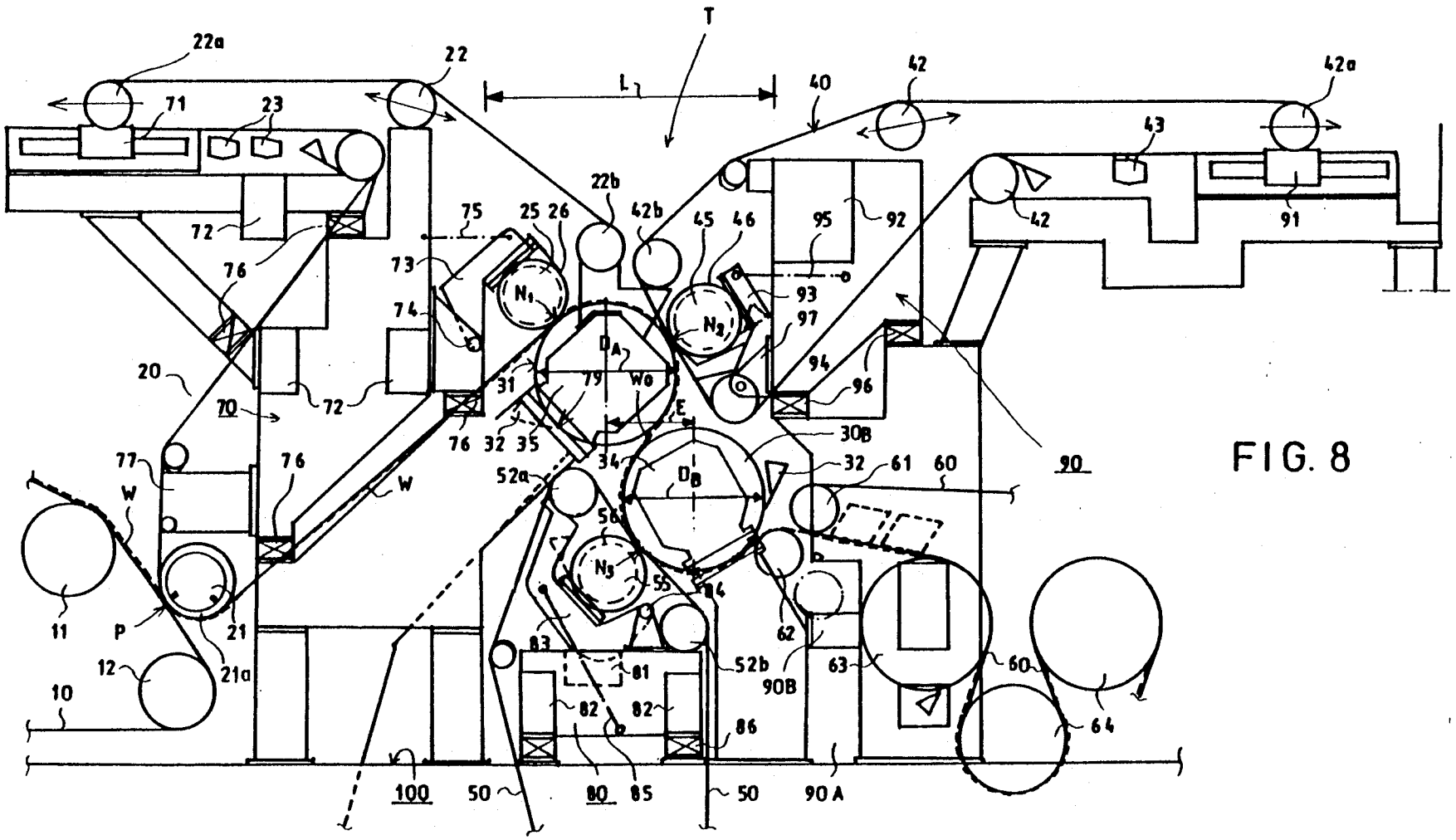
FIG. 8 is a schematic side elevation view of a frame construction according to the invention for a press section of the type shown in FIG. 1.
Figure 9:
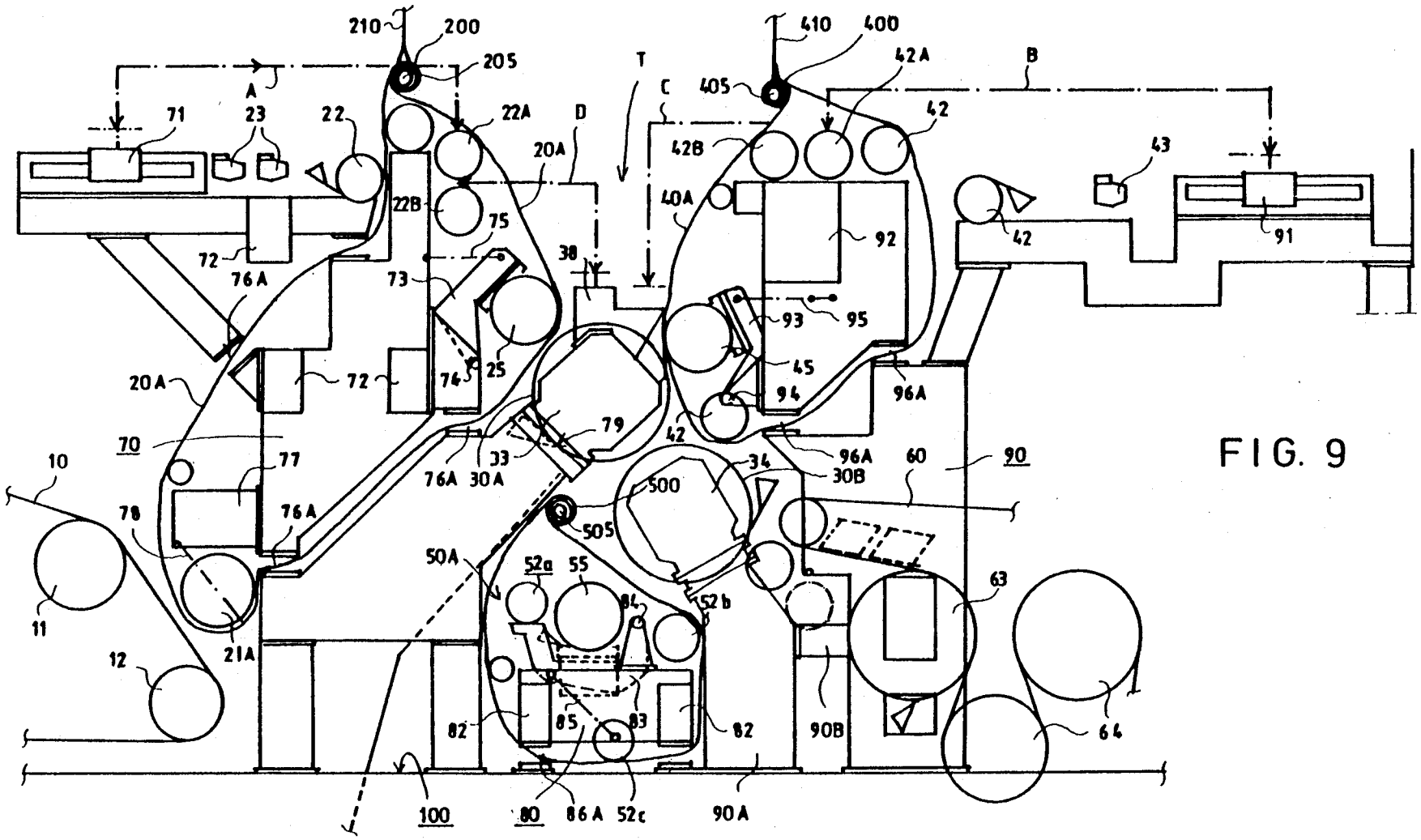
FIG. 9 illustrates the replacement of press fabrics in a press section and frame construction of the type shown in FIG. 8.
Figure 10:
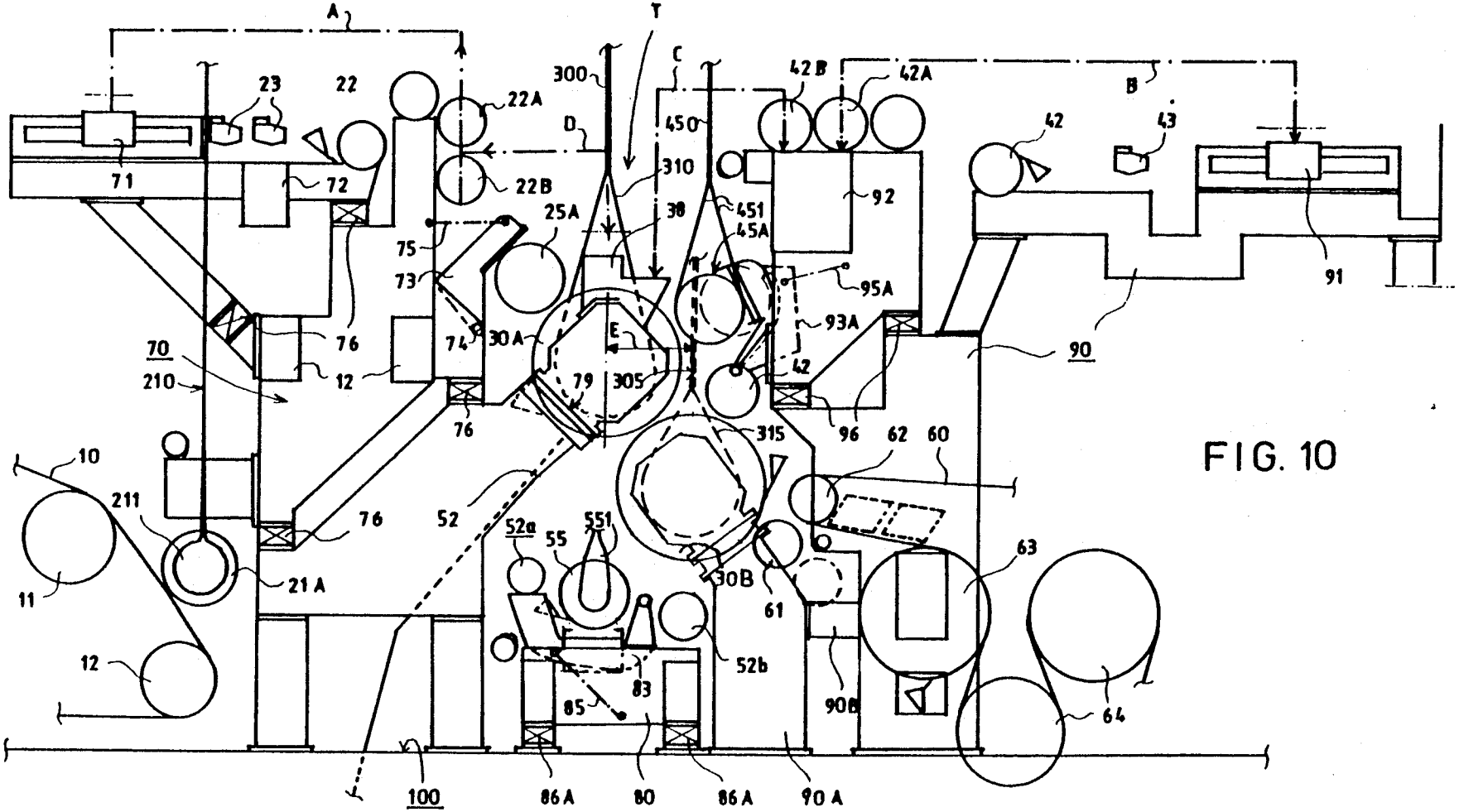
FIG. 10 illustrates the replacement of press rolls in a press section and frame construction of the type shown in FIG. 8.

Referring now to FIGS. 8–10, a press section frame construction in accordance with the invention comprises a front frame 70, an intermediate frame 80, and a rear frame 90, the frames resting on a foundation 100 of the paper machine hall. The intermediate frame 80 is located beneath the compact press roll combination of the press section. It is a characteristic of a frame construction in accordance with the invention that the front frame 70 and the rear frame 90 are not connected to each other and that there is an open free space T above the press roll combination of the press section which facilitates the replacement of the press rolls and fabrics as will be seen from the description in connection with FIGS. 9 and 10.

For purposes of the present description, it will be understood that when reference is made to the front and rear frames not being connected to each other, it is meant that the front and rear frames are at least not permanently connected to each other by large, frame beams.

The front frame 70 comprises cantilevered cross beams 72 and side frame members attached to the cross beams 72. A tensioning device 71 is provided in the upper part of the front frame 70 for the upper guide roll **22*a* of fabric 20. Removable intermediate members 76 are provided at the service side of the front frame 70 of the paper machine through which the first fabric 20 can be replaced. The first center roll 30A is permanently journalled on bearing supports 33 attached to the diagonal front side members 79 of the front frame. The press roll 25 of the first nip $N_1$ is also supported on the front frame 70 so that the bearing supports of press roll 25 are attached to a pivotal intermediate part 73 linked by means of horizontal articulated joints 74 onto the front part of the front frame 70 so as to be pivotable by means of power units 75** for the purpose of loading and/or opening the first press nip $N_1$.

The intermediate frame 80 comprises cantilevered cross beams 82 and side members in which removable intermediate pieces 86 are provided. The guide rolls 52 for the lower press fabric 50 are journalled on intermediate members 83 of the intermediate frame 80. The press roll 55 of the third press nip $N_3$ is also journalled on intermediate frame 80 with its bearing supports being attached to the intermediate members 83. Intermediate members 83 are connected to the intermediate frame 80 by means of horizontal articulated joints 84 and are adapted to be loaded and pivotted by means of power units 85. A cross beam 81 may be provided on intermediate frame 80 in connection with which the roll 55 can be withdrawn, such as on a roller conveyor line.

The second center roll 30B is journalled on a relatively low front part 90 which is attached to and forms a part of the rear frame by means of intermediate members 90B.

Figure 11:
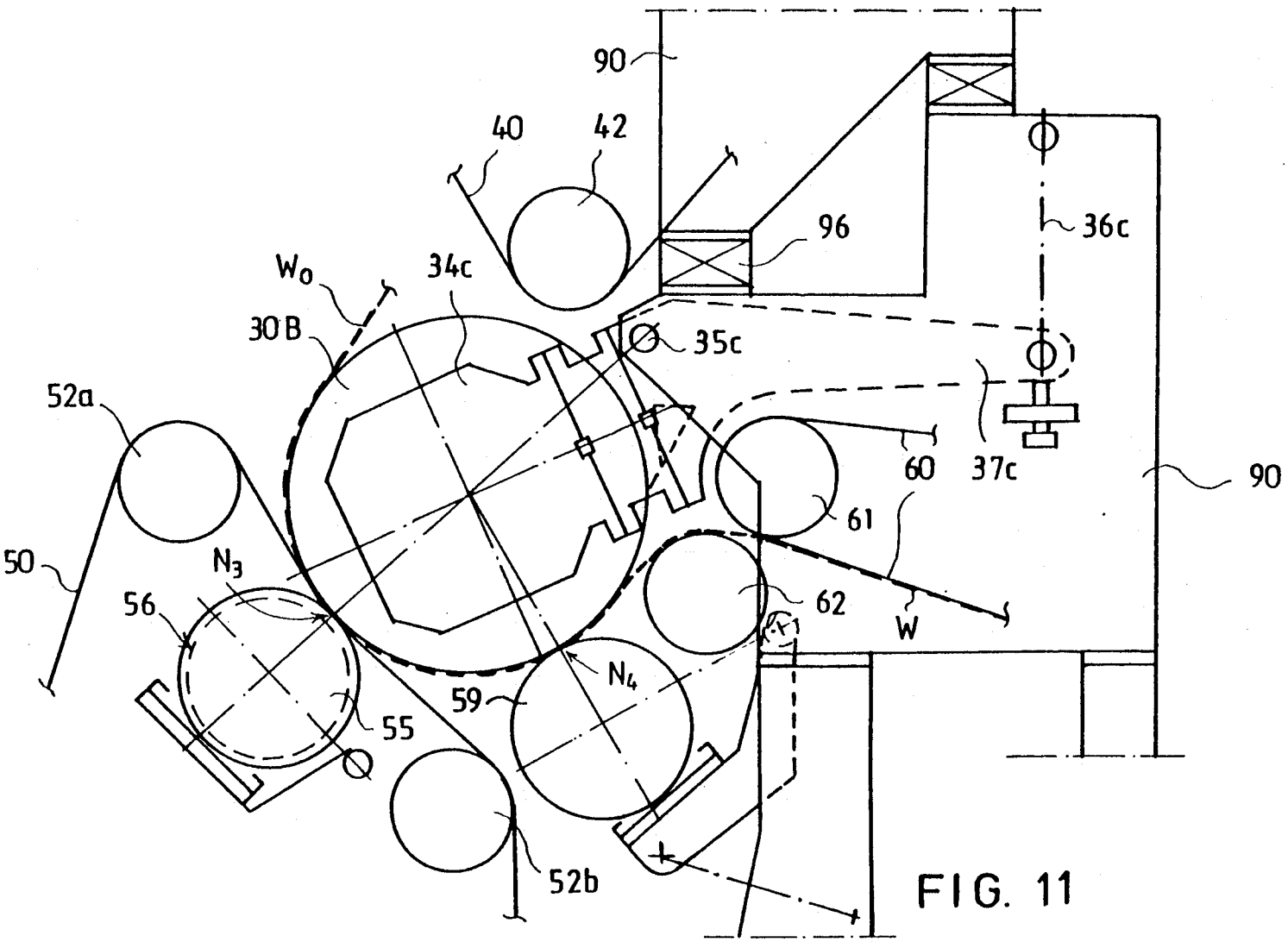
FIG. 11 illustrates an embodiment of the invention wherein, in a press section in accordance with the invention having one center roll situated above the other center roll, the lower center roll is supported by means of a pivotal intermediate part coupled to the front side of the rear frame.

Referring to FIG. 11, the press section includes a fourth press nip $N_4$ formed by rolls 30B and 59, the fourth nip $N_4$ constituting an equalizing press. In this embodiment, the rear frame 90 comprises a single part so that the bearing supports **34*c* of center roll 30B are attached to the front side of the rear frame 90. The bearing supports (not shown) of press roll 59 of the fourth nip $N_4$ can be attached to the intermediate members which are linked to the front part of the rear frame 90** by means of horizontal joints so as to be pivotable by means of power units to load and/or open the nip.

When a rear frame 90 comprising two parts 90A and 90B is used, the intermediate part 90B may be entirely omitted. Alternatively and in accordance with FIG. 11, the bearing supports **34*c* of the second center roll 30B are attached to the intermediate members 37*c* and linked by means of horizontal articulated joint 35*c* to the front side of the rear frame 90 so as to be pivotable by means of power units 36*c*. The horizontal joint 35*c* is preferably located on a straight line extending substantially through the center points of the rolls 55 and 30B**.

Returning to FIG. 8, the bearing supports of the press roll 45 forming the second nip $N_2$ are attached to intermediate members 93 which are coupled to the front side of the rear frame 90 or to projecting parts 97 by means of horizontal articulated joints 94 so as to be pivotable by means of power units 95 for loading and/or opening the nip $N_2$. Adjoining guide rolls **22*b* and 42*b* of the first and second fabrics 20 and 40, which are situated close to each other at the free space T between the front and rear frames, are mounted on the intermediate members 38 which are also attached to the upper part of the bearing supports 33 of the first center roll 30A**.

The intermediate members 73 of press roll 25 of the first press nip $N_1$ can be attached to the bearing supports 33 of center roll 30A or to their projecting parts by means of an openable intermediate part or joint. In a corresponding manner, the intermediate parts 93 of the press roll 45 forming the second press nip $N_2$ can be openably attached to the bearing supports 33 of the center roll 30A or to projecting parts thereof. In this manner, different loading units are coupled to the intermediate members 73 and 93 and the bearing supports of rolls 25 and 45 are connected to the different loading units.

Referring now to FIG. 9, the replacement of the various press fabrics of a press section in accordance with the invention utilizing a frame construction of the type shown in FIG. 8 will now be described.

In the replacement of fabric 20, an old fabric is first removed by opening the pick-up point P by shifting the pick-up roll to the position 21A. The nip $N_1$ is opened by pivoting press roll 25 by actuating power units 75 towards the front frame 70. The intermediate members 76 are removed so that intermediate spaces 76A are provided. The upper guide roll **22*a* is shifted from its tensioning devices 71 along the path designated A to an inner holding site in connection with the upper part of the frame 70, i.e., to a position 22A. Likewise, the guide roll 22*b* located above the center roll 30A is shifted along a path D to a holding site 22B situated in connection with the front frame 70. After removing the old fabric, a fabric roll 200 carried on a replacement pole 205 and having been opened to form a loop 20A is carried on lifting wires 210 to the service side of the paper machine whereupon the fabric loop 20A is passed through the intermediate spaces 76A in the position shown in FIG. 9 into position within the front frame 70. Thereafter, the fabric loop 20A is spread out and the intermediate member 76 replaced. The rolls 22*a* and 22*b* are shifted along paths A and B to their normal operating positions and while at the same time opening fabric loop 20A**.

In replacing the lower fabric 50, the intermediate pieces 86 are removed and the nip $N_3$ is opened by pivoting the intermediate members 83 and press roll 55 and guide roll **52*a* attached to it by actuating power unit 85. Any guide roll that may be located in the basement space is reised to an upper position 52*c* within intermediate frame 80. Thereafter, the fabric roll 500, supported on a replacing pole 505 and having been opened to a loop 50A, is passed through the intermediate spaces 86A around the intermediate frame 80 whereupon the intermediate pieces 86 are replaced to close the spaces 86A. The fabric 50** is tensioned and the nip $N_3$ is closed.

In the replacement of the second upper fabric 40, the old fabric is removed by opening the nip $N_2$ by shifting the roll 45 by means of power unit 95, and the upper guide roll **42*a* mounted on tensioning devices 91 is shifted along the path B to a holding site 42A above the rear frame 90. In a corresponding manner, the guide roll 42*b* located above the center roll 30A is shifted along the path C to its holding site 42B above the rear frame 90. The intermediate pieces 96 are removed and the new fabric carried on replacing roll 405 in the form of a roll 400 is carried by lifting wires 410 into association with the press section. The fabric is opened to a loop 40A and positioned around the rolls 42A, 42B, 45 and around the cross beam 92 through the intermediate spaces 96A. The fabric loop 40A is opened from its double roll 400 to its full length by shifting the rolls 42A and 42B along paths B and C to their operating positions 42*a* and 42*b*. The nip $N_2$ is closed and the intermediate pieces 96 are replaced and the fabric 40 is tensioned. As seen from the foregoing and referring to FIG. 9, the open space T defined between the front and rear frames 70 and 90 is efficiently utilized in the replacement of the upper fabrics 20 and 40**.

The replacement of the various rolls of the press section mounted on the frame construction of the invention will now be described with reference to FIG. 10. The suction roll 21 is replaced while in the position 21A by suspending it on the lifting loops 211 of lifting wires 210 by its axle journals.

The press rolls of the compact roll combination, i.e. rolls 30A, 30B, 25, 45, 55 and 59, are replaced utilizing the open intermediate space T. Alternatively, the lowermost press roll 55 may be replaced by means of a roller conveyor provided in connection with beam 81 by pulling the roll 55 from the frame construction in its longitudinal direction towards the service side of the paper machine while at the same time one end of the roll 55 is supported by means of wires 551.

In the replacement of the press rolls, the adjoining guide rolls **22*b* and 42*b* of fabrics 20 and 40 are shifted through the space T to the holding sites 22B and 42B along paths D and C as described above. The nips $N_1$ and $N_2$ are opened and press rolls 25 and 45 are replaced, if necessary. As seen in FIG. 10, press roll 45 is replaced by suspending the roll by its axle journals on the loops 451 of lifting wires 450. If the replacement of rolls 25 and/or 45 is not required, the frame parts can be dimensioned so that when the pres rolls 25 and 45 have been pivoted by power units 75 and 95 to their inner positions, shown in FIG. 10 in the case of roll 45*a* by dash lines and reference numerals 93A and 95A, the gap between the rolls 25 and 45 is sufficiently large so that the rolls 30A and 30B have enough space to pass between the press rolls. As seen in FIG. 10, the lifting loops 310 of the lifting wires 300 are attached to the axle journals of the center roll 30A so that the roll can be lifted through the space T and, if necessary, be rotated upon reaching the space above the press section to extend in the machine direction. The roll 30B is removed after the removal of roll 30A by means of lifting wires 305 whose loops 315 are attached to the axle journals of the roll 30B. Center roll 30B may also be withdrawn from the machine in its longitudinal direction when the roll 30*a* is in position with the distance between the rolls 30A and 30B** being designated E.

After the rolls 30A and 30B have been removed, press roll 55 can also be removed through the space T or by withdrawing it from the press section in its longitudinal direction in the case where the center rolls 30A and 30B have not been replaced.

It will be understood that new rolls are provided into respective operating positions by carrying out the above-described operations in a reverse order.

A conventional traverse crane or cranes operating at the ceiling of the paper machine hall is used for lifting the rolls and for supporting the fabric-replacing poles 205, 405 and 505.

The replacement of the press rolls and, in particular, the large and massive center rolls 30A and 30B, can also be carried out by a mid-lifting technique, i.e., by supporting the roll by means of a single lifting wire at its center of gravity. The lifting wire is then attached to a pair of lifting loops forming an inverted V shape. Such a mid-lifting technique is preferable in replacing the press rolls in that the rolls can be rotated to extend in the machine direction in a safe manner above the press section thereby facilitating the replacement of the rolls.

The length L (FIG. 8) of the open space T is chosen taking both the replacement fabrics and rolls as well as the minimization of the size of the frame part of the press and the overall geometry of the press into account. Preferably, the length L of open space T is on the order of $k \times D$, wherein D is the diameter of the center rolls and k is a constant in the range of between about 1.5 to 3, most preferably about 2.

Besides facilitating the replacement of press rolls and press fabrics, the frame construction of the invention also promotes safety and reduces space requirements, particularly at the service side of the paper machine since the press rolls need not be longitudinally shifted to the service side of the machine. It is an additional advantage that the construction is simplified since conveyor means required for longitudinal shifting of the rolls is not required. The provision of such conveyor means has in the past resulted in several problems in connection with compact press roll combinations. On the other hand, due to the circumstances described above, the construction of the press can be made even more compact and therefore enables the reduction of space requirements and operating and investment expenditures It will also be understood that the frame construction shown in FIGS. 8–10 can be utilized in principle with press sections where the center rolls 30A and 30B are situated substantially at the same level.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A press section of a paper machine, said press section comprising a plurality of press rolls forming a compact press roll combination including a center roll and at least two more press rolls each forming a press nip with the center press roll and said press section comprising a frame construction on which said rolls are mounted, comprising a front frame and a rear frame between which there is an intermediate space open or openable directly above said press roll combination such that said press rolls of said press roll combination are accessible for removal and replacement through said intermediate space, said front and rear frames being unconnected, or at least not permanently connected, to each other directly above said press rolls of said press roll combination, and wherein said press rolls are dimensioned and situated such that said press rolls are removable from said press section in a substantially vertical direction through said intermediate space.

2. The press section of claim 1, wherein a paper web runs between said press nips without extended unsupported draws, and wherein a first one of said press rolls is supported in conjunction with said front frame and a subsequent one of said press rolls is supported on said rear frame such that the front and rear frames are coupled to each other through said press nips formed between each of said first and subsequent one of said press rolls and the center roll.

3. The press section of claim 2, further comprising a pivotable intermediate part supporting said first one of said press rolls in said compact press roll combination, said intermediate part being pivotally connected to said front frame, and power means coupled to said intermediate part for opening and closing a nip formed by said first one of said press rolls and said center roll, and comprising at least one articulated joint situated to a side of, and not directly above, said press roll combination and connecting said pivotable intermediate part to said front frame for pivoting said pivotable intermediate part to an open position by said power means in which said first of said press nips of said compact press roll combination is opened.

4. The press section of claim 2, further comprising a plurality of bearing supports for a second one of said plurality of press rolls, power means and a pivotable intermediate part connected to said bearing supports of said second press roll, said second press roll being subsequent in the running direction of a web passing through said compact press roll combination to the first press roll in said compact press roll combination and wherein said second press roll comprises said subsequent press roll or another of said plurality of press rolls, and at least one articulated joint connecting said intermediate part to a front side of said rear frame such that said intermediate part can be pivoted to an open position by said power means such that a press nip subsequent to the first of said press nips in said compact press roll combination can be opened.

5. The press section of claim 3, further comprising a plurality of bearing supports for one of said press rolls, power means and an intermediate part connected to bearing supports of a press roll subsequent in the running direction of a web passing through said compact press roll combination to said first press roll in said press roll combination, said one of said press rolls comprising said subsequent press roll or another of said plurality of press rolls, and at least one articulated joint connecting said intermediate part to a front side of said rear frame such that said intermediate part can be pivoted to an open position by said power means such that a press nip subsequent to the first of said press nips in said compact press roll combination can be opened.

6. The press section of claim 2 further comprising a guide roll located above said compact press roll combination for guiding a press fabric through a first press nip formed by said compact press roll combination, and said press section further comprising tensioning means for adjusting the position of said guide roll to tension said press fabric, said upper guide roll being displaceable to an inner holding site adjacent to said front frame to facilitate replacement of said press fabric.

7. A press section of a paper machine comprising a compact press roll combination comprising a plurality of press rolls including a center roll and first and second press rolls each forming a press nip with said center roll, a frame construction comprising a front frame and a rear frame between which there is an intermediate space open or openable at the top, said front and rear frames being unconnected, or at least not permanently connected, to each other above the rolls of said press roll combination, a plurality of press nips formed in conjunction with said plurality of press rolls between which a web runs without extended unsupported draws, first press rolls of said plurality of press rolls in a direction of travel of the web supported in conjunction with said front frame and at least one subsequent press roll of said plurality of press rolls supported in conjunction with said rear frame so that the front and rear frames are linked to each other through the press nips formed between said first and second press rolls and said subsequent press roll each with the center roll, said first and second press rolls being hollow-faced press rolls and said center roll being smooth-faced, and said press section comprising a plurality of bearing supports for said first hollow-faced press roll, which forms a press nip with said smooth-faced center roll, a first upper fabric passing through said press nip, and said press construction comprising a pivotable intermediate part attached to said bearing supports and horizontal articulated joints attached to said pivotable intermediate part and to a front part of the front frame so as to be pivotable in an open position and said frame construction comprising power means for pivoting said intermediate part, and said press section further comprising other bearing supports for said subsequent press roll in a subsequent press nip formed between said center roll, said subsequent press roll provided with a hollow face, said press section comprising a second upper fabric passing through said subsequent press nip, and said frame construction comprising another intermediate part attached to said other bearing supports and said other horizontal articulated joints attached to said another intermediate part and to a front side of the rear frame or to projection parts thereof so as to be pivotable in an open position, and said press construction comprising power means for pivoting said other intermediate part, said intermediate parts, frame structures, press fabrics and press rolls being dimensioned and situated such that said open-topped intermediate space is substantially directly above said press rolls and of at least said first and second upper press fabrics, and said frame construction is structured and arranged such that said press rolls are removeable from said press section in a substantially vertical direction through said intermediate space.

8. A press section of a paper machine comprising: a plurality of press rolls forming a compact press roll combination including a center roll and at least two more press rolls each forming a press nip with the center roll, and a frame construction on which said plurality of press rolls are mounted, said frame construction including a front frame and a rear frame, a first one of said press rolls being supported in conjunction with said front frame and a subsequent one of said press rolls being supported in conjunction with said rear frame such that said front and rear frames are coupled to each other through said press nips formed between each of said first and said subsequent one of said press rolls and said center roll, said frame construction comprising means for permitting removal of said press rolls from said press section through a space situated substantially directly over said compact press roll combination and said frame construction being structured and arranged such that said press rolls are removable from said press section in a substantially vertical direction through said space.

9. The press section of claim 8, wherein said compact press roll combination forms a plurality of press nips between which a paper web runs without extended unsupported draws.

10. The press section of claim 8, wherein said removal permitting means further comprises a pivotable intermediate part supporting said first one of said press rolls in said compact press roll combination, said intermediate part being pivotally connected to said front frame, and power means coupled to said intermediate part for opening and closing a nip formed by said first of said press rolls and comprising at least one articulated joint connecting said pivotable intermediate part to said front frame for pivoting said pivotable intermediate part to an open position by said power means such that one of said press nips of said compact press roll combination is opened.

11. The press section of claim 8, further comprising a plurality of bearing supports for one of said press rolls of said compact press roll combination, said one of said press rolls being subsequent in the running direction of a web passing through said compact press roll combination, and said removal permitting means further comprising a pivotable intermediate part supporting said first one of said press rolls in said compact press roll combination, said intermediate part being pivotally connected to said front frame, and power means coupled to said intermediate part for opening and closing as nip formed by said first of said press rolls and said removal permitting means further comprising at least one articulated joint connecting said pivotable intermediate part to said front frame for pivoting said pivotable intermediate part to an open position by said power means such that one of said press nips of said compact press roll combination is opened.

12. The press section of claim 9, further comprising a plurality of bearing supports for one of said press rolls of said compact press roll combination, said one of said press rolls being subsequent in the running direction of a web passing through said compact press roll combination, and said removal permitting means further comprising a pivotable intermediate part supporting said first one of said press rolls in said compact press roll combination, said intermediate part being pivotally connected to said front frame, and power means coupled to said intermediate part for opening and closing a nip formed by said first of said press rolls and comprising at least one articulated joint connecting said pivotable intermediate part to said front frame for pivoting said pivotable intermediate part to an open position by said power means such that one of said press nips of said compact press roll combination is opened.

13. The press section of claim 8, further comprising a guide roll located above said compact press roll combination for guiding a press fabric through a first press nip formed by said compact press roll combination, and said press section further comprising tensioning means for adjusting the position of said guide roll to tension said press fabric, said upper guide roll being displaceable to an inner holding site adjacent to said front frame to facilitate replacement of said press fabric.

14. A press section of a paper machine, comprising a frame construction including a front frame and a rear frame, a compact press roll combination comprising a center roll, a first press roll, a second press roll, and additional press rolls, said compact press roll combination arranged such that a first press nip is defined between said center roll and said first press roll, and a second press nip is defined between said center roll and said second press roll, said front frame and said rear frame being coupled to each other through said first and second press nips, said first press roll being supported by first bearing supports attached to a first pivotal intermediate part linked by first horizontal articulated joints to said front frame such that said first press nip may be opened or closed, and said second press roll being supported by second bearing supports attached to a second pivotal intermediate part pivotally linked to a front part of said rear frame such that said second press nip may be opened or closed, an open or openable space existing directly above said compact press roll combination such that said rolls can be replaced by lifting said rolls in a substantially vertical direction through said space and out of said frame construction when said nips are opened.

15. The press section of claim 14, wherein said first and second intermediate frame parts are situated substantially to respective sides of said compact press roll combination.

16. The press section of claim 14, further comprising a first upper fabric passing through said first press nip and a second upper fabric passing through said second press nip, said first or second upper fabrics being replaceable through said open or openable space when said first press nip or said second press nip is opened, respectively.

17. A press section of a paper machine, comprising a frame construction including a front frame and a rear frame, a compact press roll combination comprising a plurality of press rolls including a center roll, a first press roll, and a second press roll, said compact press roll combination arranged such that a first press nip is defined between said center roll and said first press roll, and a second press nip is defined between said center roll and said second press roll, said front frame and said rear frame being coupled to each other through said first and second press nips formed between said first and second press rolls each with said center roll, said first press roll being linked to said front frame by first pivotable means such that said first press nip may be opened or closed, and said second press roll being linked to said rear frame by second pivotable means such that said second press nip may be opened or closed, such that an open or openable space exists directly above said compact press roll combination and between upper portions of said front frame and said rear frame such that said rolls can be replaced by lifting said rolls in a substantially vertical direction through said space and out of said frame construction when said nips are opened.

18. A press section of a paper machine, comprising a frame construction including a front frame and a rear frame, a compact press roll combination comprising a plurality of press rolls including a center roll, a first press roll, and a second press roll, said compact press roll combination arranged such that a first press nip having a first upper fabric running therethrough is defined between said center roll and said first press roll, and a second press nip having a second upper fabric running therethrough is defined between said center roll and said second press roll, said first press roll being linked to said front frame by first pivotable means such that said first press nip may be opened or closed, said second press roll being linked to said rear frame by second pivotable means such that said second press nip may be opened or closed, said first and second pivotable means substantially situated to a side of said compact combination press roll combination, said front frame and said rear frame being coupled to each other through said first and second press nips, such that an open or openable space exits directly above said compact press roll combination and between upper portions of said front frame and said rear frame such that said press rolls, said center roll, and said upper fabrics can be replaced by lifting said press rolls in a substantially vertical direction through said space and out of said frame construction when said nips are opened.

19. A press section of a paper machine, comprising a frame construction including a front frame and a rear frame, a compact press roll combination comprising a plurality of press rolls forming a compact press roll combination including a center press roll, a first press roll, and a second press roll, said compact press roll combination arranged such that a first press nip having a first upper fabric running therethrough is defined between said center press roll and said first press roll, and a second press nip having a second upper fabric running therethrough is defined between said center press roll and said second press roll, said front frame and said rear frame being coupled to each other through said first and second press nips, such that an open or openable space exits directly above said compact press roll combination and between upper portions of said front frame and said rear frame, said first and second press rolls each having a respective diameter and said center roll having a diameter substantially larger than said respective diameters of said first and second press rolls, said first press roll being linked to said front frame by first pivotable means such that said first press nip may be opened or closed, and said second press roll being linked to said rear frame by second pivotable means such that said second press nip may be opened or closed, such that when said nips are opened, said open or openable space has a length from about 1.5 to about 3 times the diameter of said center roll, and such that said center roll, said press rolls and said upper fabrics are replaceable by lifting the same in a substantially vertical direction out of said frame construction when said nips are opened.

* * * * *